US007156674B1

(12) United States Patent
Frank

(10) Patent No.: US 7,156,674 B1
(45) Date of Patent: Jan. 2, 2007

(54) PHYSICAL SECURITY SYSTEM FOR WIRELESS ACCESS POINTS WITH CABLE SECURITY BRACKET AND LOCKING BRACKET

(75) Inventor: Timothy Frank, Parma, OH (US)

(73) Assignee: Cisco Technology, Inc., San Jose, CA (US)

( * ) Notice: Subject to any disclaimer, the term of this patent is extended or adjusted under 35 U.S.C. 154(b) by 0 days.

(21) Appl. No.: 11/214,308

(22) Filed: Aug. 29, 2005

(51) Int. Cl.
*H01R 13/44* (2006.01)

(52) U.S. Cl. ..... 439/133

(58) Field of Classification Search ..... 439/133, 439/135, 139, 134, 136, 140, 141, 367, 373; 174/67

See application file for complete search history.

(56) References Cited

U.S. PATENT DOCUMENTS

| | | | | |
|---|---|---|---|---|
| 5,220,815 | A * | 6/1993 | Davidge et al. | 70/14 |
| 5,488,208 | A * | 1/1996 | Seewald | 200/43.22 |
| 6,811,415 | B1 * | 11/2004 | Chen | 439/133 |
| 2005/0095885 | A1 * | 5/2005 | Lindner | 439/133 |

* cited by examiner

*Primary Examiner*—Chandrika Prasad
(74) *Attorney, Agent, or Firm*—Tucker Ellis & West LLP

(57) ABSTRACT

A physical security system for an access point that enables an installer to route a cable for the access point through a cable security bracket. The access point is installed onto a mounting bracket. A locking bracket is installed that engages the access point and the mounting bracket and locked while the access point is installed onto the mounting bracket. Once the bracket is installed and locked, the system does not allow for the access point or the cable to be removed.

8 Claims, 8 Drawing Sheets

PHYSICAL SECURITY SYSTEM FOR WIRELESS ACCESS POINTS WITH CABLE SECURITY BRACKET AND LOCKING BRACKET

CROSS-REFERENCE TO RELATED APPLICATIONS

This application is related to U.S. application Ser. No. 10/266,377 filed on Oct. 8, 2002 and to U.S. application Ser. No. 10/983,822 filed on Nov. 8, 2004, both of which are assigned to Cisco Technology, Inc., the assignee of this application.

BACKGROUND OF THE INVENTION

This invention is directed to physical security systems for wireless access points. More particularly, this invention is directed to a physical security system for wireless access points that prevent removal of the access point and cables.

Users of wireless access points are concerned about the physical security of distributed access points throughout their facilities. These security concerns include theft of the access points and hacking into the user's network via unauthorized access to the access point's I/O panel connectors, such as the Ethernet, fiber and/or console port connectors.

To address these security problems, access point users are placing the access points in metal security boxes to secure the access points. However, this solution results in other problems, such as degradation of the thermal design due to excessive heating of the access point which leads to lowered reliability, early product failure, and high warranty return costs. This solution also causes degradation and compromise of the electrical, electromagnetic compatibility, and regulatory certification of the access point. Further, it leads to destruction of the branding and esthetic design of the access point's standard enclosure as the brand name and design are hidden inside the metal box. In addition, the access point's visual indicators, such as the status indicators and the Ethernet indicators are hidden from the user. Furthermore, the installation of the security boxes is expensive and time consuming.

There is a need for a security system for wireless access points which overcomes these limitations.

BRIEF SUMMARY OF THE INVENTION

In accordance with the present invention, there is provided a physical security system for wireless access points which overcomes the limitations of earlier security systems. Further in accordance with the present invention, there is provided a security system for access points which prevents theft, I/O panel connector removal, and access to the ports by unauthorized users. Additionally, the security system does not hide the branding and aesthetic design of the access point enclosure. In accordance with an aspect of the present invention, an installer can route a cable through a cable security bracket and then install a locking bracket and lock while the access point is installed onto the mounting bracket. Once the locking bracket is installed and locked, the system does not allow for the access point and the cable to be removed.

In accordance with an aspect of the present invention, there is disclosed herein a physical security system comprising a mounting plate with a top surface and a side. The mounting plate having apertures for mounting to an external surface, the mounting plate further having tabs on the top surface and a slot on the side. The physical security system also has an access point having a top surface and a bottom surface, a first side with a port for attaching an external cable, and a second side with a slot, the bottom surface of the access point having slots matching the tabs of the mounting plate so that the access point slideably engages the mounting plate by sliding the slots of the access point on the tabs of the mounting plate. A cable security bracket is coupled to the mounting plate having an opening for retaining the external cable secured to the first side of the access point. A locking bracket having a first end and a second end, the first end configured to engage the slot on the second side of the access point, the second end having sufficient width to fit through the slot on the mounting plate and having an aperture suitable for receiving a locking mechanism therethrough. When the second end of the locking mechanism engages the slot on the mounting bracket, the locking bracket prevents the access point from from sliding on the mounting plate. The external cable is one of the group consisting of a power cable, an Ethernet cable and a console cable.

In accordance with an aspect of the present invention, there is disclosed herein a physical security system comprising a mounting plate. The system further comprises means for mounting the mounting plate to an external surface. The system also has an access point having a top surface, a bottom surface, a first side and a second side. The system further comprising means for retaining a cable attached to the first side of the access point, means for engaging the access point with the mounting plate, and means for coupling the second side of the access point with the mounting plate. When the means for coupling is engaged, the means for coupling prevents the means for engaging the access point with the mounting plate from disengaging.

In accordance with an aspect of the present invention, there is disclosed herein, a method for providing physical security to an access point having a first side with a slot and a second side with a port for receiving a cable. The method comprising attaching a cable security bracket having an opening and a corresponding slot to a mounting plate, installing the mounting plate onto an external surface, the mounting plate having tabs, inserting a cable through a slot on a cable security bracket coupled to the and positioning the cable in an opening of a cable security bracket, installing the access point onto the mounting plate, the access point having slots matching the tabs on the mounting plate, wherein the access point slideably engages the mounting plate, and securing the access point to the mounting plate by inserting a locking bracket having first and second ends, the first end inserted into the slot on the access point and the second end engaging the mounting bracket.

Still other objects of the present invention will become readily apparent to those skilled in this art from the following description wherein there is shown and described a preferred embodiment of this invention, simply by way of illustration of one of the best modes best suited for to carry out the invention. As it will be realized, the invention is capable of other different embodiments and its several details are capable of modifications in various obvious aspects all without departing from the invention. Accordingly, the drawing and descriptions will be regarded as illustrative in nature and not as restrictive.

BRIEF DESCRIPTION OF THE SEVERAL VIEWS OF THE DRAWING

The accompanying drawings incorporated in and forming a part of the specification, illustrates several aspects of the present invention, and together with the description serve to explain the principles of the invention.

DETAILED DESCRIPTION OF INVENTION

Throughout this description, the preferred embodiment and examples shown should be considered as exemplars, rather than limitations, of the present invention. Like numbers are used to indicate like components.

Figure 1:
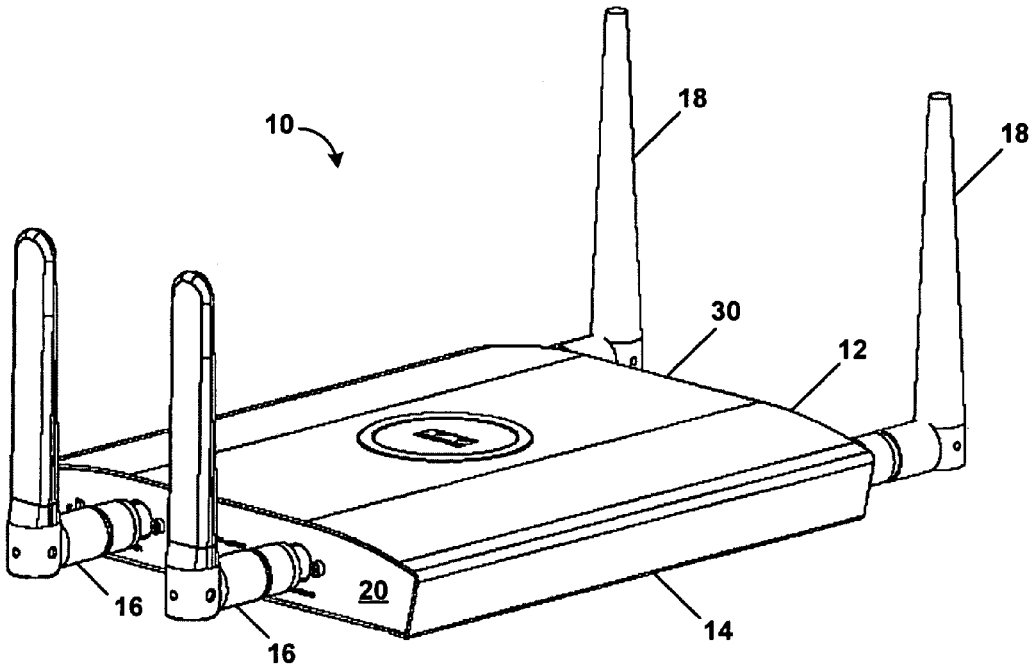
FIG. 1 is an isometric drawing of an access point.

Referring to FIG. 1, there is illustrated an access point 10 comprising a top side 12 and a bottom side 14. The access point has a first side 20 with antennas 16 and a second side 30 with antennas 18. Top side 12 is a solid surface and when in place prevents access to the interior (not shown) and bottom of access point 10. Although FIG. 1 shows antennas 16 are different from antennas 18, this is not important to the scope of the present invention. In the example illustrated in FIGS. 1–3, access point 10 is capable of operating on two frequencies, 5 GHz and 2.4 Ghz, however, the present invention is suitably adaptable to an access point utilizing any operating frequency or frequencies.

Figure 2:
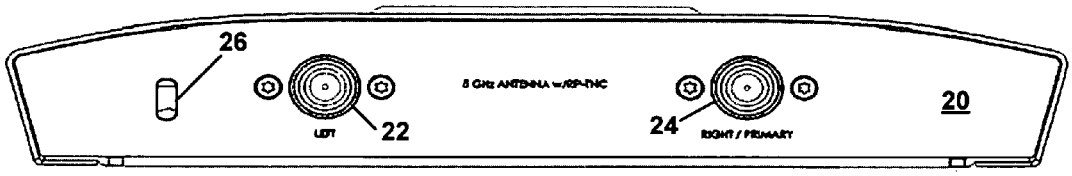
FIG. 2 is a first side view of an access point.

FIG. 2 is an exemplary illustration of side 20 of access point 10. Side 20 comprises couplers 22, 24 for coupling with antennas 16. Side 20 also has a slot 26. Preferably, slot 26 is a Kensington style slot (Available from Kensington Technology Group, 333 Twin Dolphin Drive, Sixth Floor, Redwood Shores, Calif. 94065). As will described herein infra, slot 26 is adapted to receive a first end of a locking bracket (see FIG. 10) to secure access point 10 to a mounting bracket 40 (see FIG. 14).

Figure 3:
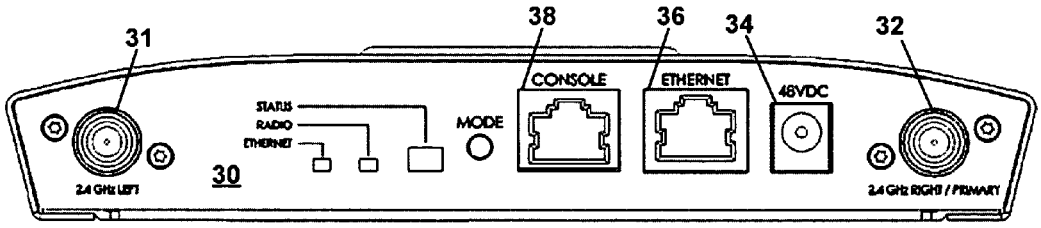
FIG. 3 is a second side view of an access point.

FIG. 3 is an exemplary illustration of side 30 of access point 10. Side comprises antenna couplers 31, 32 and has a power port 34, Ethernet port 36 and Console port 38. An aspect of the present invention is to retain cables plugged into one or more of power port 34, Ethernet port 36 and Console port 38. Power coupler 34 receives external power for access point 10. If the power cable is removed, then power to access point 10 is interrupted. Ethernet port 36 couples access point 10 to the backbone network or distribution system (not shown). Access to Ethernet port 36 could enable a rogue device to access the network by using the cable (not shown) coupled to Ethernet port 36. Furthermore, preventing disconnection of a cable (not shown) coupled to Ethernet port 36 is also desirable because the access point 10 is unable to properly function when it is disconnected from the network. Console port 38 is used by service technicians to setup access point 10. The technician can view and if desired change settings for access point 10 via console port 38. For example, by accessing console port 38 an intruder may be able to determine the encryption parameters used by access point 10, thus enabling an intruder to gain unauthorized access to the network. Therefore, it is desirable to prevent an intruder from accessing console port 38.

Figure 4:
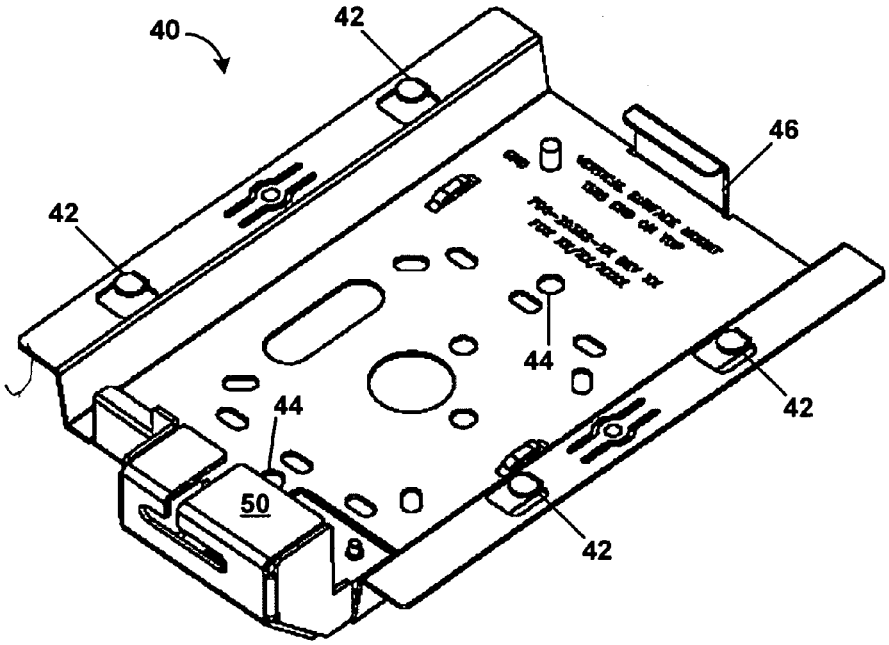
FIG. 4 is a top view of a mounting plate.
Figure 5:
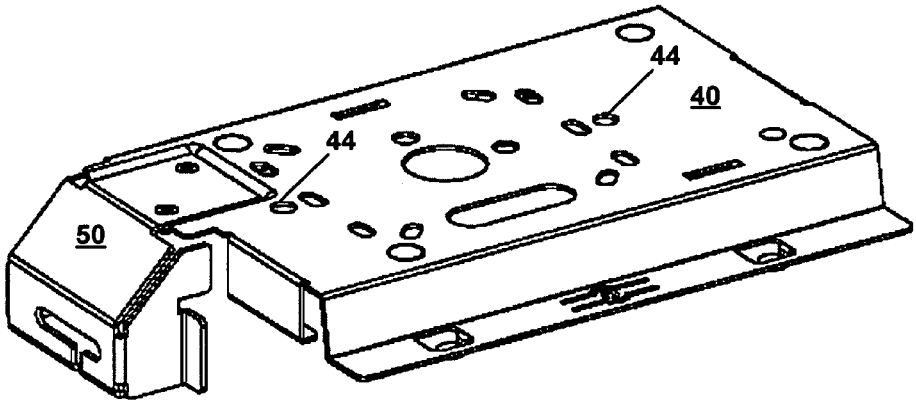
FIG. 5 is a bottom view of a mounting plate.

FIG. 4 is a top view of a mounting plate 40 and FIG. 5 is a bottom view of mounting plate 40. As will be described herein infra, mounting plate 40 is used for securing access point 10 to an external surface, such as a wall, ceiling or other surface. Mounting bracket 40 comprises tabs 42 which are configured to align with and engage corresponding slots 60 (FIG. 16) on the bottom surface 14 of access point 10. Mounting plate 40 has apertures 44 for engaging the external surface that access point 10 is being mounted on. Cable security bracket 50 is affixed to mounting bracket 40. As will be described herein infra, cable security bracket 50 is employed to retain any cables coupled to one or more of power port 34, Ethernet port 36 and Console port 38 (FIG. 3) and/or to prevent access to power port 34, Ethernet port 36 and Console port 38. Mounting bracket 40 has a surface 46 that forms an opening when an access point is coupled to mounting bracket 40 (see FIG. 14).

Figure 6:
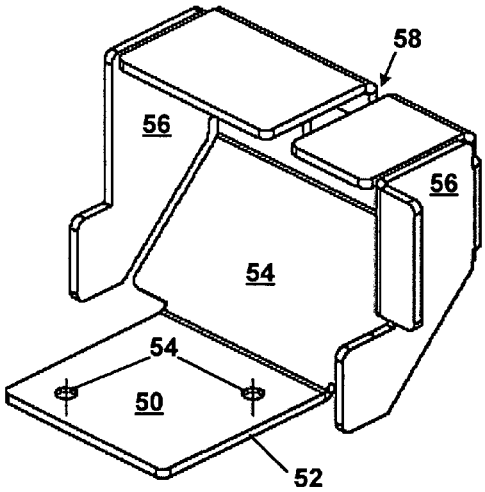
FIG. 6 is an isometric view of a cable security bracket.
Figure 7:
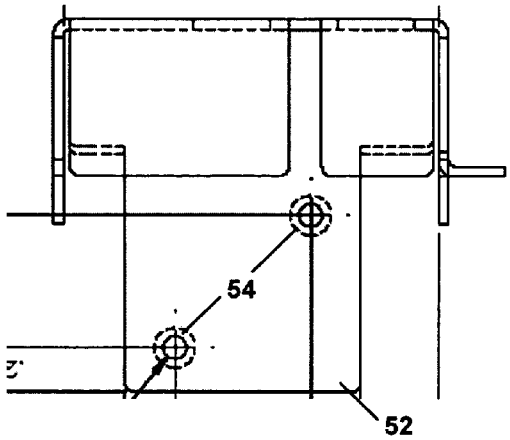
FIG. 7 is a top view of a cable security bracket.
Figure 8:
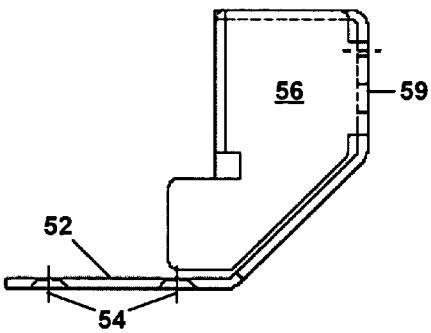
FIG. 8 is a side view of a cable security bracket.
Figure 9:
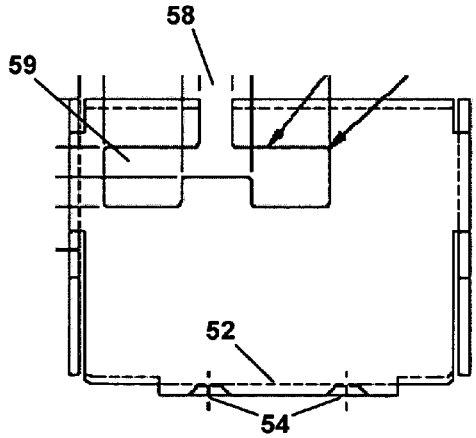
FIG. 9 is a rear view of a cable security bracket.

FIGS. 6–9 illustrates various views of cable security bracket 50. FIG. 6 is an isometric view of cable security bracket 50, FIG. 7 is a top view of cable security bracket 50, FIG. 8 is a side view of cable security bracket 50 and FIG. 9 is a rear view of cable security bracket 50. Cable security bracket 50 comprises a bottom surface 52 with apertures 54 for receiving fasteners for coupling security bracket 50 with mounting plate 40. As will be described herein infra, surface 54 extending from bottom surface 52 prevents access to ports 34, 36, 38 when the cable security bracket 50 is coupled to mounting plate 40 and access point 10 is coupled to mounting plate 40. Side surfaces 56 are coupled to surface 54. As will be described herein infra, opening 59 is used to retain cables plugged into one or more of ports 34, 36, 38. Slot 58 coupled to opening 59 is used for receiving cables for ports 34, 36, 38. Slot 58 and opening 59 are of sufficient width for the cable to pass through, however slot 58 and opening 59 are of insufficient width to allow cable ends to pass through. When it is desired to retain a cable using cable security bracket 50, the end of the cable is slid through slot 58 towards opening 59. As will be described herein infra, when access point 10 is mounted on mounting bracket 40, cable security bracket 50 retains the cables and prevents removal. Because opening 59 and slot 58 are too small for the cable ends to fit through, once the access point 10 is installed on mounting bracket 40, cable security bracket 50 prevents external cables from being inserted into ports 34, 36, 38.

Figure 10:
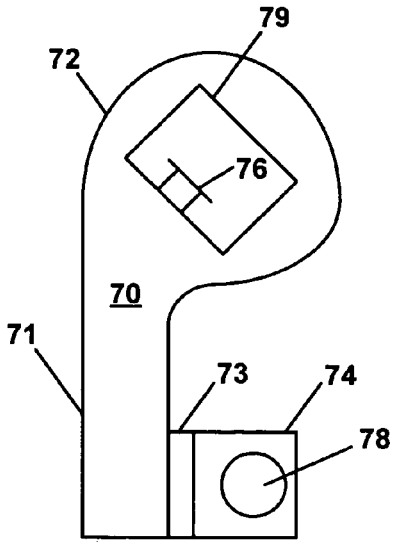
FIG. 10 is a front view of a locking bracket.
Figure 11:
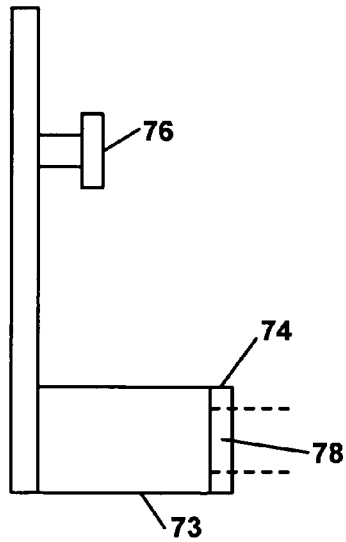
FIG. 11 is a side view of a locking bracket.

FIGS. 10 and 11 illustrated a locking bracket 70 for securing access point 10 to mounting plate 40. FIG. 10 is a front view of locking bracket 70 and FIG. 11 is a side view of a locking bracket 70. Locking bracket 70 has a main surface 71 coupled to a first end 72 and a second end 74. An offset surface 73 is coupled between main surface 71 and second end 74 for aligning second 74 with a slot in mounting plate 40 which will be described herein infra. Aperture 78 is located in second end 74 of locking bracket 70. A T shaped member 76 is coupled to first end 72 of locking bracket 70. An opening 79 at first end 72 is employed to provide visual access to T shaped member 76.

Figure 12:
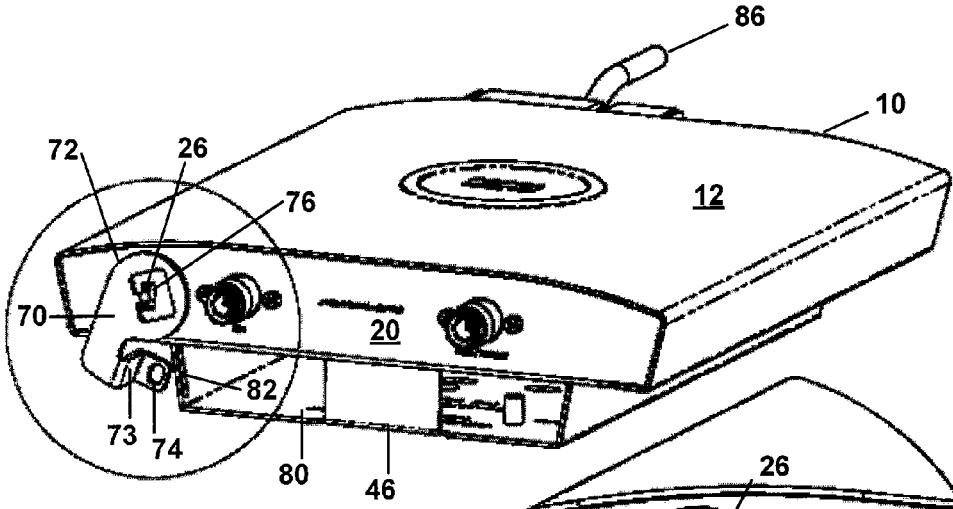
FIG. 12 is an isometric view of an access point mounted on a mounting plate with a locking bracket in an unsecured position.
Figure 13:
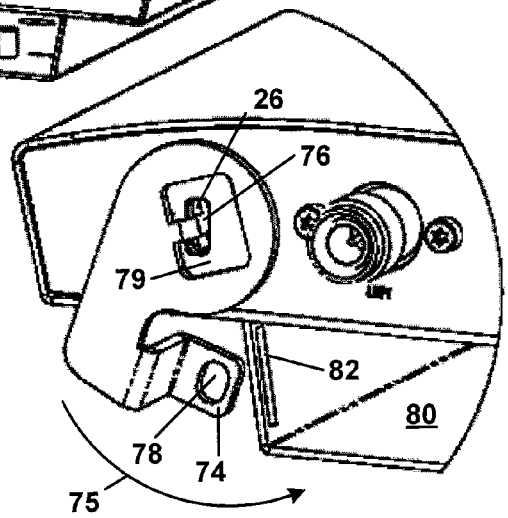
FIG. 13 is a detailed view of FIG. 12 of the locking bracket in an unsecured position.

FIG. 12 is an isometric view of access point 10 mounted on a mounting bracket 40 with locking bracket 70 in an unsecured position. FIG. 13 is a detailed view of FIG. 12 with locking bracket 70 in an unsecured position. T shaped member 76 is aligned and inserted into slot 26. Opening 79 can be employed to provide visual access to T shaped member 76 and aid in aligning T shaped member 76 with slot 26 for insertion. Offset 73 aligns second end 74 of locking bracket 70 with slot 82 in mounting plate 40. An opening 80 is formed when access point 10 engages mounting plate 40. As illustrated in FIG. 13, rotating locking bracket 70 along path 75 causes T shaped member 76 to engage slot 26 and prevent T shaped member from being removed from slot 26 and second end 74 slides through slot 82 on mounting plate 40.

Figure 14:
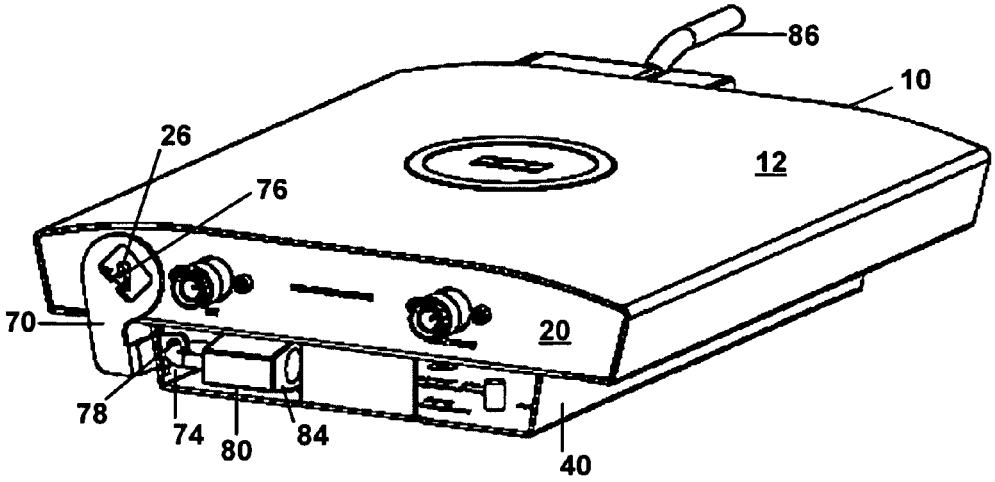
FIG. 14 is an isometric view of an access point mounted on a mounting plate with a locking bracket in the secured position and secured by a padlock.

FIG. 14 is an isometric view of first side 20 of access point 10 mounted, when access point 10 is mounted on mounting bracket 40 with locking bracket 70 in the secured position and secured by padlock 84. T shaped member 76 is no longer aligned with slot 26, causing T shaped member 76 to engage slot 26 and preventing the removal of locking bracket 70 from access point 10. Second end 74 is passed through slot 82. Padlock 84 engaging aperture 78 of second end 74 prevents locking bracket 70 from disengaging mounting bracket 40. Thus, because T shaped member 76 prevents locking bracket from disengaging from slot 26 of access point 10 and padlock 84 engaging aperture 78 prevents second end 74 of locking bracket 70 from passing through slot 82 of mounting bracket 40, locking bracket 40 prevents access point 10 from being removed from mounting plate 40.

Figure 15:
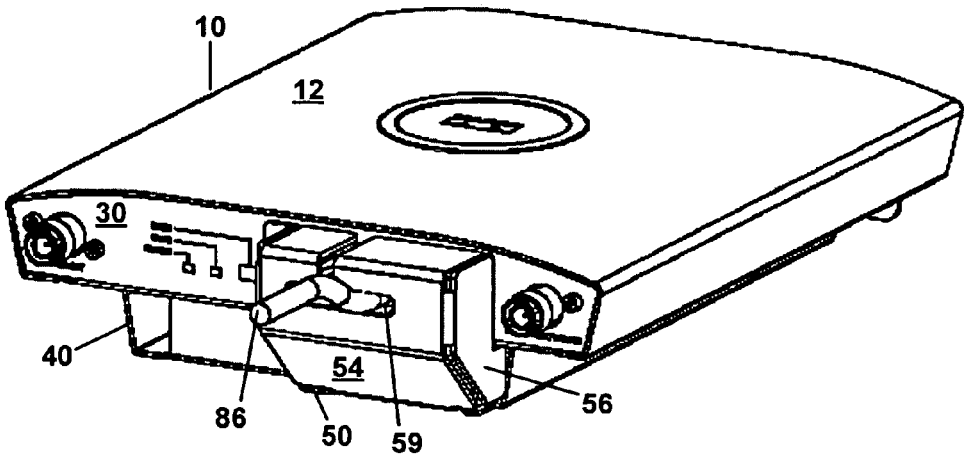
FIG. 15 is an isometric view of an access point mounted on a mounting plate with cable security bracket.

FIG. 15 is an isometric view of the second side 30 of access point 10 that is mounted on mounting bracket 40 with cable security bracket 50. Cable 86 exits opening 59. Opening 59 is of sufficient size to permit cable 86 to pass through, but of insufficient size to let the coupler (not shown) at the end of cable 86 to pass through. Furthermore, because opening 89 is too small to allow the end of a cable to pass through, it prevents access to ports 34, 36, 38 (FIG. 3). Bottom surface 54 and surfaces 54, 56 surround and prevent access to ports 34, 36, 38.

Thus, as can be observed from FIGS. 14 and 15, when cover 12 is on access cover 10, and access cover is engaged to mounting plate 40 via locking bracket 70 and cable security bracket is coupled to mounting bracket 40, access point 10 is secured to mounting bracket 40, and ports 34, 36, 38 and any cables connected to ports 34, 36, 38 are also protected. Furthermore, when access point 10 is mounted on mounting bracket 40, access point 10 prevents access to the underlying fasteners (not shown) coupling mounting bracket 40 to the mounting surface (not shown). Although, the examples just set forth show locking bracket 70 cable security bracket 50 on different sides 20, 30 respectively of access point 10, it is contemplated that locking bracket 70 cable security bracket 50 can be adapted to be coupled to any side of access point 10, and may even be located on the same side, e.g., either side 20 or side 30 of access point 10.

Figure 16:
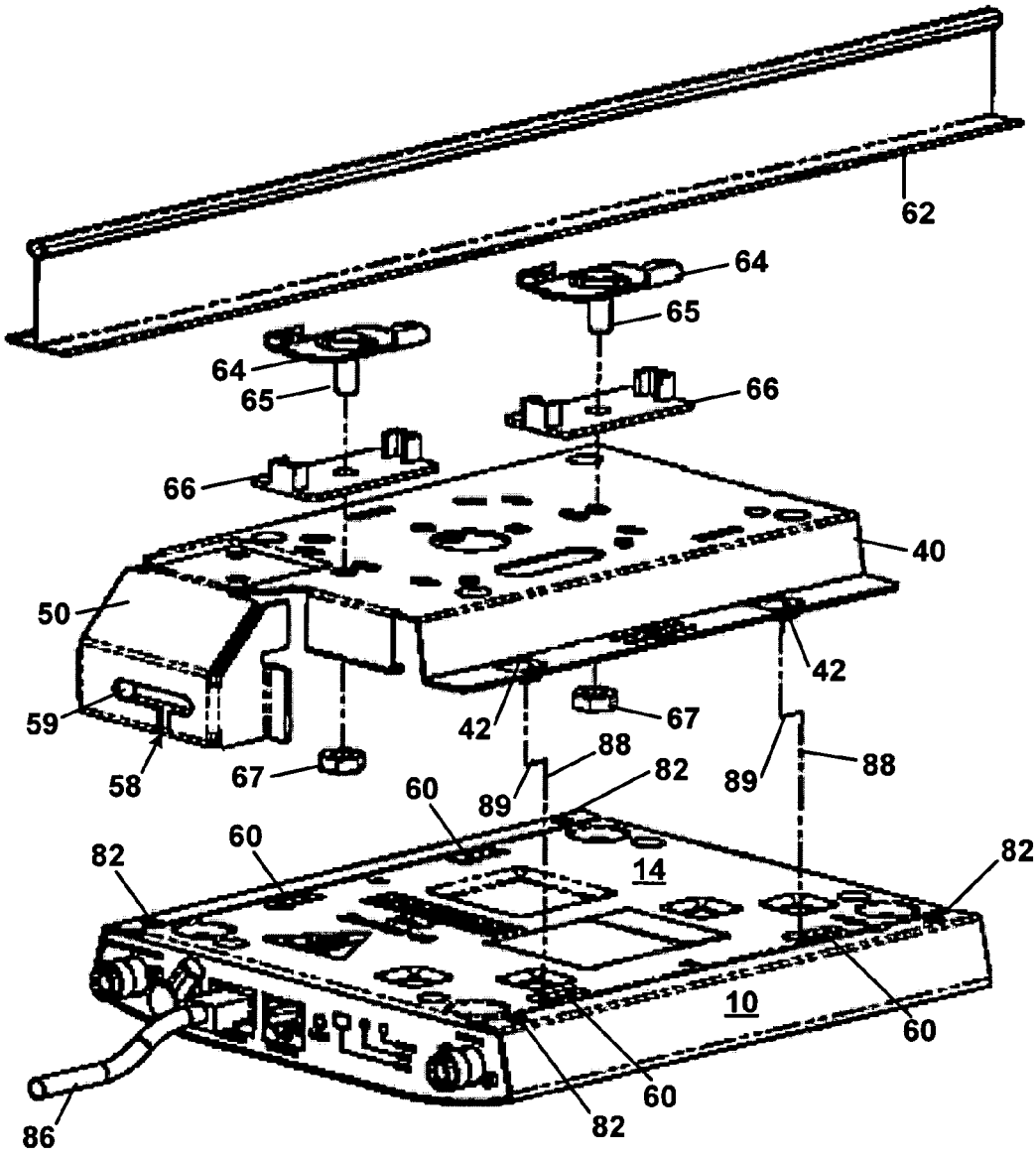
FIG. 16 is an exploded view of a system for mounting an access point to a rail.

FIG. 16 is an exploded view of a physical security system for mounting access point 10 to a rail 62. Clips 64 slide onto rail 62. Spacers 66 slide over a cylindrical protruding section 65 of clips 64. Mounting bracket 40 then slides onto cylindrical protruding sections 65 and is fastened onto clips 64 by nuts 67. Cable security bracket 50 is coupled to the bottom of mounting bracket 40. Screws 82 hold the top section 12 of access point 10 onto the bottom section 14 of access point 10. When access point 10 is secured to mounting bracket 40, mounting bracket 40 bocks access to screws 82, thus securing the top section of access point 10.

Access point 10 is coupled to mounting bracket 40 by slots 60 engaging tabs 42 as illustrated by lines 88. Access point 10 is moved towards mounting bracket 40, cable 86 is inserted through slot 58 to opening 59. When slots 60 of access point 10 are properly aligned with corresponding tabs 42, access point 10 is slide in a horizontal direction 89 so that tabs 42 engage slots 60. When locking bracket 70 secures access point 10 to mounting bracket 40 as illustrated in FIG. 14, this prevents access point 10 from being removed from mounting bracket 40 by preventing access point 10 from sliding off of mounting bracket 40.

Figure 17:
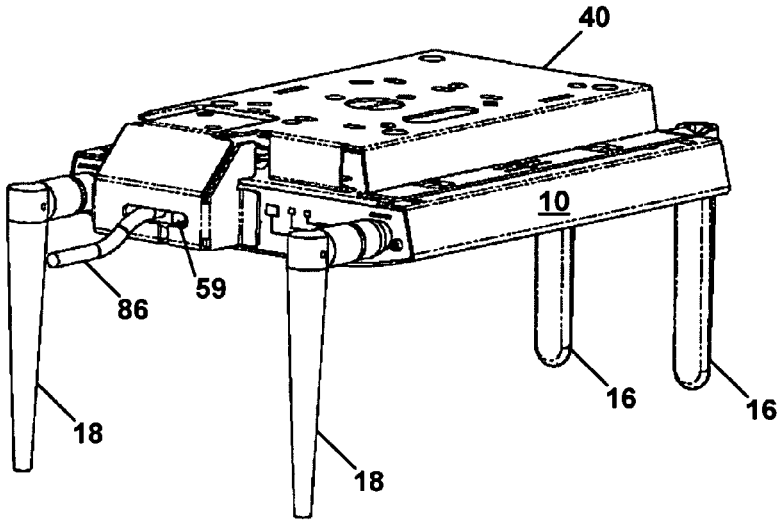
FIG. 17 is an isometric view of an access point mounted on a mounting plate with cable security bracket.

FIG. 17 is an isometric view of access point 10 mounted on mounting bracket 40 with cable security bracket 50 retaining cable 86. FIG. 17 illustrates how the physical security system employing cable security bracket 50 and locking bracket 70 do not interfere with antennas 16, 18.

What has been described above includes exemplary implementations of the present invention. It is, of course, not possible to describe every conceivable combination of components or methodologies for purposes of describing the present invention, but one of ordinary skill in the art will recognize that many further combinations and permutations of the present invention are possible. Accordingly, the present invention is intended to embrace all such alterations, modifications and variations that fall within the spirit and scope of the appended claims interpreted in accordance with the breadth to which they are fairly, legally and equitably entitled.

The invention claimed is:

1. A physical security system, comprising:

a mounting plate with a top surface and a side, the mounting plate having apertures for mounting to an external surface, the mounting plate further having tabs on the top surface and a slot on the side;

an access point having a top surface and a bottom surface, a first side with a port for attaching an external cable, and a second side with a slot, the bottom surface of the access point having slots matching the tabs of the mounting plate so that the access point slideably engages the mounting plate by sliding the slots of the access point on the tabs of the mounting plate;

a cable security bracket coupled to the mounting plate having an opening for retaining the external cable secured to the first side of the access point; and a locking bracket having a first end and a second end, the first end configured to engage the slot on the second side of the access point, the second end having sufficient width to fit through the slot on the mounting plate and having an aperture suitable for receiving a locking mechanism therethrough;

wherein when the second end of the locking mechanism engages the slot on the mounting bracket, the locking bracket prevents the access point from sliding on the mounting plate; and wherein the external cable is one of the group consisting of a power cable, an Ethernet cable and a console cable.

2. A physical security system according to claim 1, wherein the external cable is two of a group consisting of a power cable, an Ethernet cable and a console cable.

3. A physical security system according to claim 1, wherein the external cable comprises a power cable, an Ethernet cable and a console cable.

4. A physical security system according to claim 1, wherein the first end of the locking bracket has a T shaped member, the T shaped member protruding from the first end at an angle wherein the T shaped member is inserted into the slot on the first side of the access point when the locking bracket is in a first position, and the T shaped member is of sufficient size so that the T shaped is retained by the slot on the first side of the access point when the locking bracket is moved into a second position.

5. A physical security system according to claim 4, wherein the locking bracket prevents the access point from sliding on the mounting plate when the locking mechanism is in the second position.

6. A physical security system according to claim 4, wherein the access point prevents access to the mounting plate when the access point is engaging the mounting plate.

7. A physical security system according to claim 6, wherein the access point prevents access to fasteners coupling the cable security bracket to the mounting plate when the access plate is engaging the mounting plate.

8. A physical security system according to claim 7, the cable security bracket further comprising:

a slot enabling the cable to slide through the slot to the opening when the access point is not engaging the mounting plate;

wherein the size of the slot and opening are sufficient to allow the cable therethrough; and wherein the size of the slot and opening are insufficient to allow the end of the cable to pass through when the access point is engaging the mounting plate.

* * * * *